US005788522A

United States Patent [19]

Kameyama

[11] Patent Number: 5,788,522

[45] Date of Patent: Aug. 4, 1998

[54] MOVABLE CONNECTOR

[75] Inventor: Isao Kameyama, Shizuoka, Japan

[73] Assignee: Yazaki Corporation, Tokyo, Japan

[21] Appl. No.: 707,714

[22] Filed: Sep. 4, 1996

[30] Foreign Application Priority Data

Sep. 4, 1995 [JP] Japan ..... 7-226590

[51] Int. Cl.[6] ..... H01R 13/64

[52] U.S. Cl. ..... 439/248

[58] Field of Search ..... 439/246–248, 439/252

[56] References Cited

U.S. PATENT DOCUMENTS

| | | | |
|---|---|---|---|
| 3,091,748 | 5/1963 | Takes et al. | 439/248 |
| 4,580,862 | 4/1986 | Johnson | 439/248 |
| 5,520,548 | 5/1996 | Hotea et al. | 439/358 |

*Primary Examiner*—Gary F. Paumen

*Attorney, Agent, or Firm*—Morgan, Lewis & Bockius LLP

[57] ABSTRACT

A movable connector is adapted to be mounted on an attachment member and a mounting member to which the attachment member is fixed, and this movable connector includes one connector for being fixedly mounted on the attachment member, a holder for being fixedly mounted on the mounting member, and the other connector movably mounted on the holder. The other connector is provisionally retained relative to the holder before the attachment member and the mounting member are completely fixed together, and the other connector is fitted relative to the one connector when the attachment member approaches the mounting member, and then this provisional retaining condition is released, and the other connector is movable within the holder by an amount corresponding to an amount of movement of the attachment member required for complete fixing to the mounting member.

8 Claims, 7 Drawing Sheets

MOVABLE CONNECTOR

BACKGROUND OF THE INVENTION

1. Field of the Invention

This invention relates to a movable connector mounted on an attachment member and a mounting member on which the attachment member is mounted, and more particularly to such a construction in which the connector in a fitted condition is movable relative to the mounting member by an amount corresponding to the amount of movement of the attachment member to its final fixed position.

2. Background

In an automobile or the like, a connector is often mounted on an attachment member and a mounting member on which the attachment member is mounted. Examples of the attachment member include some devices and an instrument panel. An example of the mounting member includes a mounting panel on a vehicle body. For example, when an instrument panel (attachment member) is to be mounted on a mounting panel (mounting member), one connector is fixedly mounted on the mounting panel, and the other connector is mounted on the instrument panel.

The two connectors are positioned with each other, and are properly fitted together when the instrument panel is fixedly mounted in position on the mounting panel. Therefore, for mounting the instrument panel, the two connectors are generally registered with each other so that they can be fitted together, and in this condition the instrument panel is fixedly secured to the mounting panel by screws or the like, so that the two connectors are properly fitted together with a predetermined depth.

However, in the above conventional connectors mounted on the attachment member and the mounting member, the predetermined depth of fitting between the two connectors is obtained only when the attachment member and the mounting member are properly fixed together, and therefore when the instrument panel and the mounting panel are fixed together in such a manner that they are not sufficiently in intimate contact with each other, for example, because of a mounting error, the connectors are not fitted together with the predetermined depth, which results in a possibility that an improper contact is encountered because of such incomplete fitting.

In the above conventional connector, the proper fitting depth is obtained only when the attachment member and the mounting member are properly fixed together, and therefore if the attachment member and the mounting member are displaced away from each other due to vibrations or others after the proper fitting is achieved, the two connectors also move away from each other, so that the high reliability of the connection between the connectors can not be achieved.

Furthermore, in the conventional connector, the two connectors are fitted together through the attachment member and the mounting member, and therefore if those portions of these members to which the two connectors are fixed, respectively, are low in rigidity, the connector is displaced relative to the attachment member or the mounting member due to a reaction force resulting from the connector fitting force, and therefore even when the attachment member and the mounting member are completely fixed together, it is possible that the two connectors fail to be completely fitted together because of such displacement.

SUMMARY OF THE INVENTION

The present invention has been made in view of the above problems, and an object of the invention is to provide a movable connector in which when an attachment member and a mounting member are fixed together, two connectors, mounted respectively on these members, are properly fitted together, thereby enhancing the contact stability and the reliability.

The above object of the present invention has been achieved by a movable connector for being mounted on an attachment member and a mounting member to which the attachment member is fixed, the movable connector including one connector for being fixedly mounted on the attachment member; a holder for being fixedly mounted on the mounting member; and the other connector movably mounted on the holder, wherein the other connector is provisionally retained relative to the holder before the attachment member and the mounting member are completely fixed together; the other connector is fitted relative to the one connector when the attachment member approaches the mounting member; the other connector is movable within the holder by an amount corresponding to an amount of movement of the attachment member required for complete fixing to the mounting member.

In the movable connector of this construction, when the one connector is fitted on the other connector mounted on the holder, the other connector, provisionally retained on the holder, is fitted into the one connector. When the attachment member, having the one connector fixedly mounted thereon, is fixed to the mounting member, having the holder fixedly mounted thereon, after the fitting between the one connector and the other connector is completed, the one connector is further pushed into the holder. When the one connector is thus pushed into the holder, the provisional retaining of the other connector relative to the holder is released, and the one connector is further pushed toward the rear end of the holder by the pushing force of the other connector. Namely, when finally fixing the attachment member, the two connectors, already fitted together, are pushed to the rear end portion of the holder by an amount corresponding to the amount of movement of the attachment member at this time.

DETAILED DESCRIPTION OF THE PREFERRED EMBODIMENTS

A preferred embodiment of a movable connector of the present invention will now be described in detail with reference to the drawings.

Figure 1:
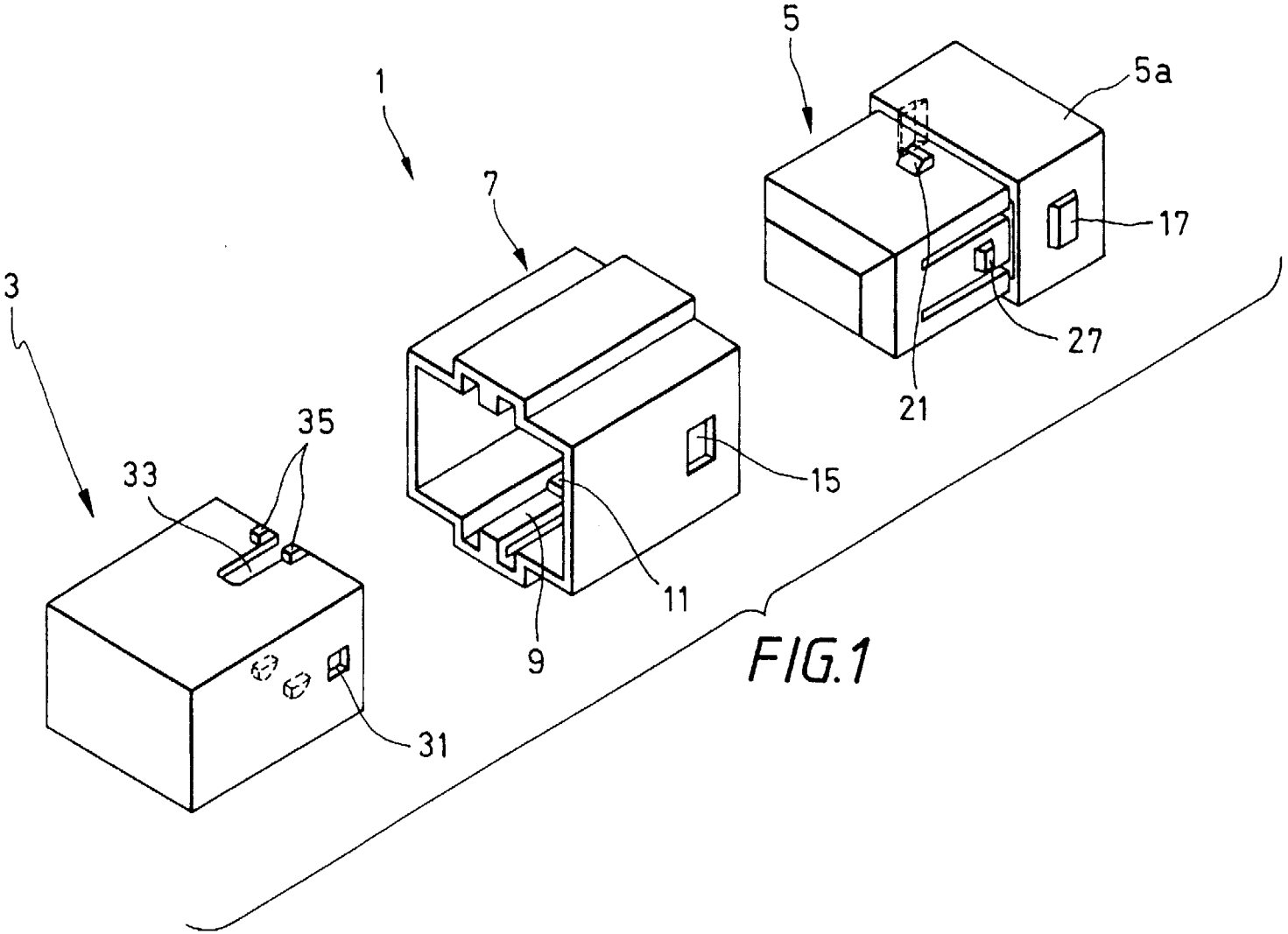
FIG. 1 is an exploded, perspective view of a movable connector of the present invention.
Figure 2:
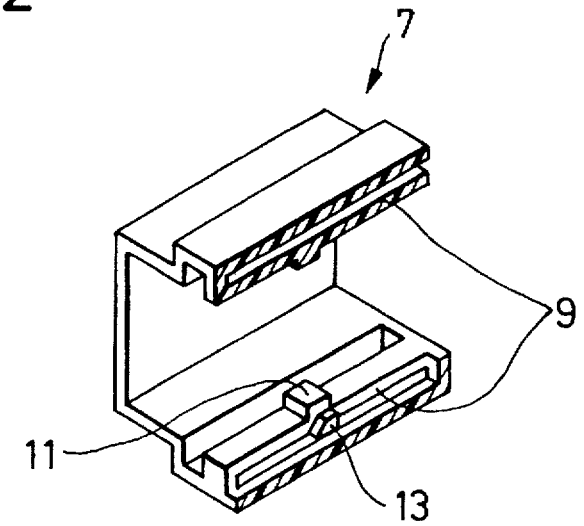
FIG. 2 is a partly-broken, perspective view of a holder used in the movable connector of FIG. 1.
Figure 3:
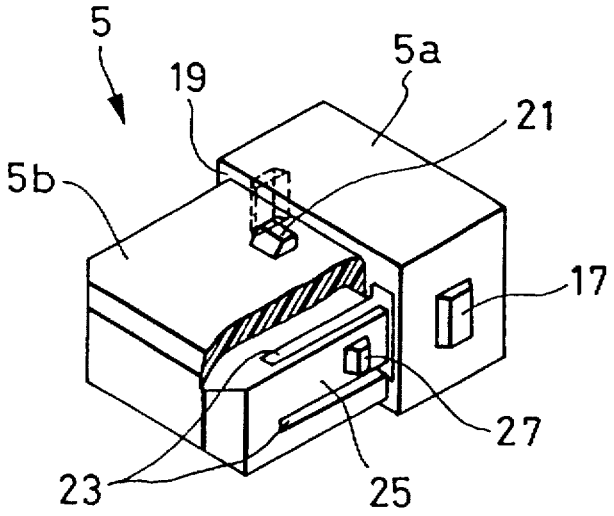
FIG. 3 is a partly-broken, perspective view of a female connector used in the movable connector of FIG. 1.
Figure 4:
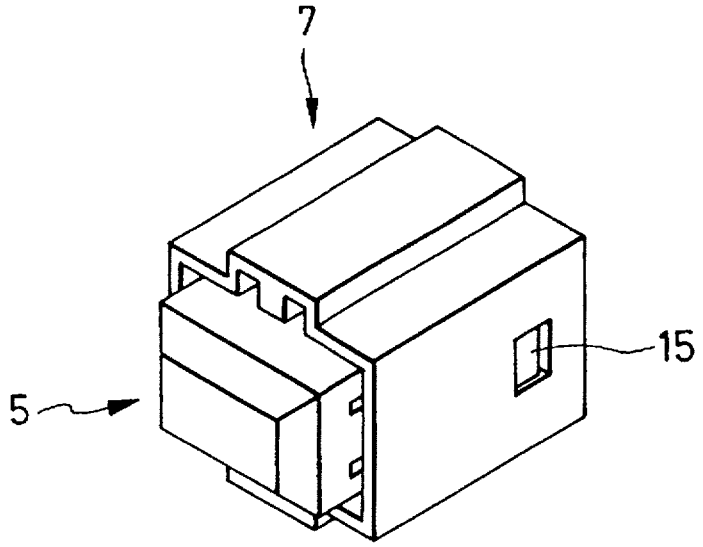
FIG. 4 is a perspective view of the holder having the female connector fitted therein.

FIG. 1 is an exploded, perspective view of the movable connector of the present invention, FIG. 2 is a partly-broken, perspective view of a holder used in the movable connector of FIG. 1, FIG. 3 is a partly-broken, perspective view of a female connector used in the movable connector of FIG. 1, and FIG. 4 is a perspective view of the holder having the female connector fitted therein.

As shown in FIG. 1, the movable connector 1 includes a male connector (one connector) 3 having male terminals mounted thereon, the female connector (the other connector) 5 having female terminals mounted thereon, and the holder 7 having the female connector 5 mounted therein. The connectors 3 and 5 may have the opposite terminals, respectively so that the male-female relation can be reversed.

The holder 7 (see FIG. 4), having the female connector 5 mounted therein, is mounted on a mounting panel (not shown) (that is, a mounting member) on a vehicle body. The male connector 3 is fixedly mounted on a meter or an instrument panel (not shown) (that is, an attachment member).

As shown in FIG. 2, the holder 7 has a hollow construction having opposite open ends, a pair of beam portions 9 each supported at its opposite ends are formed respectively on opposed inner surfaces of the holder 7. A first lock 11 is formed on each beam portion 9, and is projected within the holder 7. A pair of first projections 13 are formed respectively on opposite sides of the beam portion 9, the first projections 13 being lower in height than the first lock 11. The beam portion 9, having the first lock 11 and the first projections 13 formed thereon, is elastically deformable at its central portion. More specifically, the first lock 11 and the first projections 13 can be displaced upward and downward (FIG. 2) by the elastic deformation of the beam portion 9. A pair of first lock holes 15 (see FIG. 1) are formed respectively through opposed side walls of the holder 7. A pair of convex portions 17, formed respectively on opposite side surfaces of the female connector 5 at a proximal portion 5*a* thereof, are fitted in the first lock holes 15, respectively.

As shown in FIG. 3, a fitting portion 5*b* of the female connector 5 is smaller in outer size than the proximal portion 5*a* thereof. A step portion 19 is formed between the fitting portion 5*b* and the proximal portion 5*a*. A pair of second locks 21 are formed on and project from upper and lower surfaces of the fitting portion 5*b*, respectively, and a front end portion of each second lock 21, facing in the direction of fitting of the female connector 5, is slanting. When the female connector 5 is inserted into the holder 7, the second locks 21 are engaged respectively with the first locks 11 formed respectively on the beam portions 9 of the holder 7. An elastic piece portion 25 lying between a pair of slits 23 is formed at each of opposite side walls of the fitting portion 5*b* of the female connector 5. A third lock 27 for engagement with the male connector 3 is formed on and projects from the elastic piece portion 25.

The female connector 5 is inserted into the holder 7, fixedly mounted on the mounting panel, with the fitting portion 5*b* first introduced thereinto, and therefore is combined with the holder 7 as shown in FIG. 4. The male connector 3, shown in FIG. 1, is fitted on the female connector 5 thus mounted in the holder 7. The male connector 3 is inserted into a space between the holder 7 and the female connector 5, and is fitted on the female connector 5.

A pair of second lock holes 31 are formed respectively through opposite side walls of the male connector 3, and when the male connector 3 is fitted on the female connector 5, the second lock holes 31 are engaged respectively with the third lock portions 27 of the female connector 5. A groove 33 whose edge has a U-shape is formed in each of the upper and lower walls of the male connector 3, and extends from a front end thereof. When the male connector 3 and the female connector 5 are fitted together, the first locks 11 of the holder 7 are received in the grooves 33, respectively. A pair of right and left second projections 35 are formed respectively on opposite sides of each groove 33, and a front surface of each second projection 35, facing in a direction of fitting of the male connector 3, is slanting. When the male connector 3 is fitted on the female connector 5, the second projections 35 abut respectively against the first projections 13 formed on the beam portions 9 of the holder 7.

Figure 5:
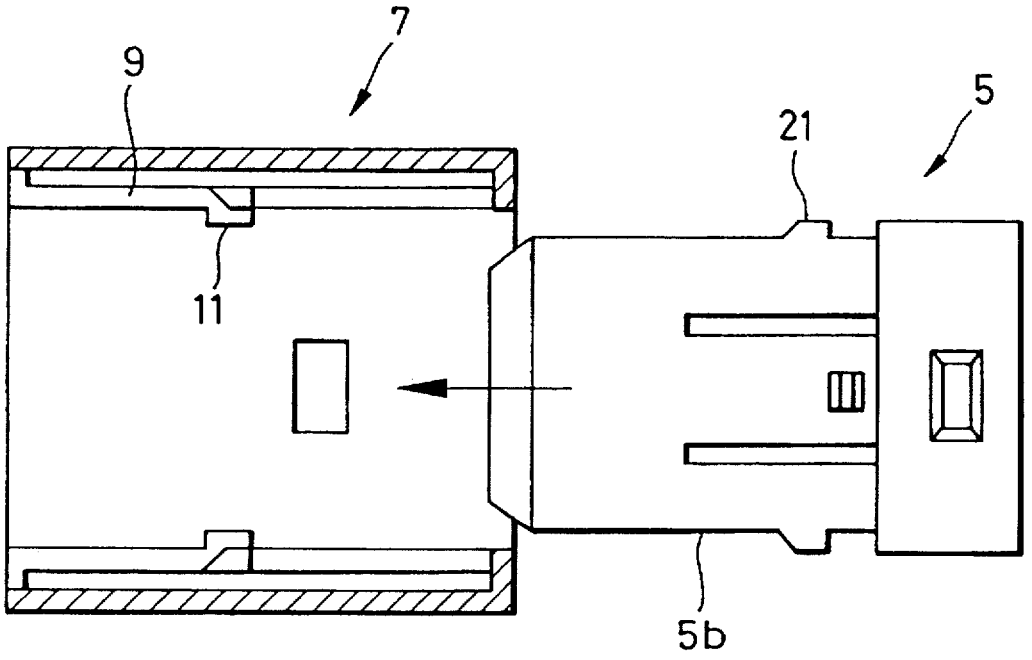
FIG. 5 is an explanatory view showing the insertion of the female connector into the holder.
Figure 7:
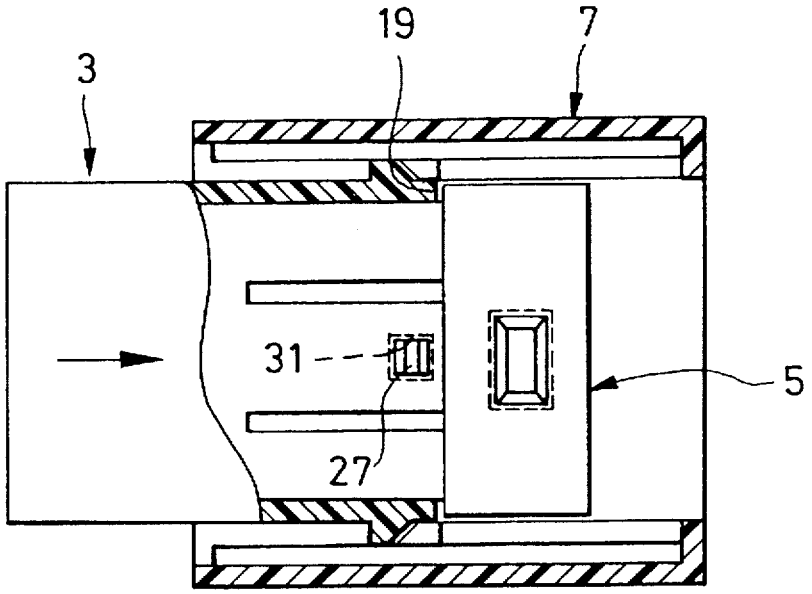
FIG. 7 is an explanatory view showing a condition in which the male connector and the female connector are completely fitted together.
Figure 8:
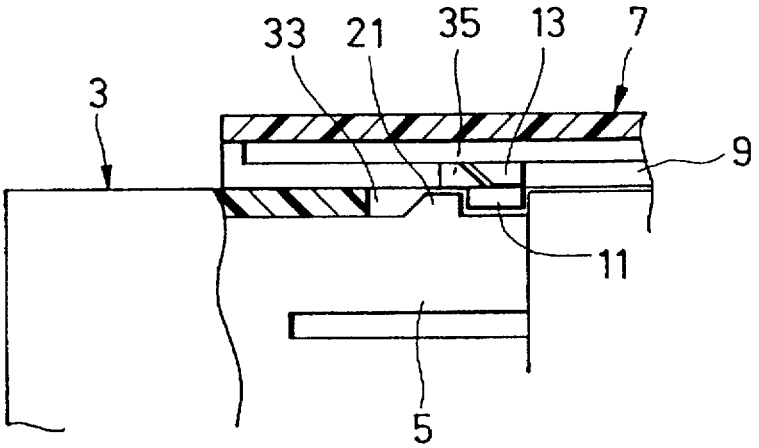
FIG. 8 is an explanatory view showing a condition in which a second projection of the male connector is abutted against the corresponding first projection of the holder.
Figure 9:
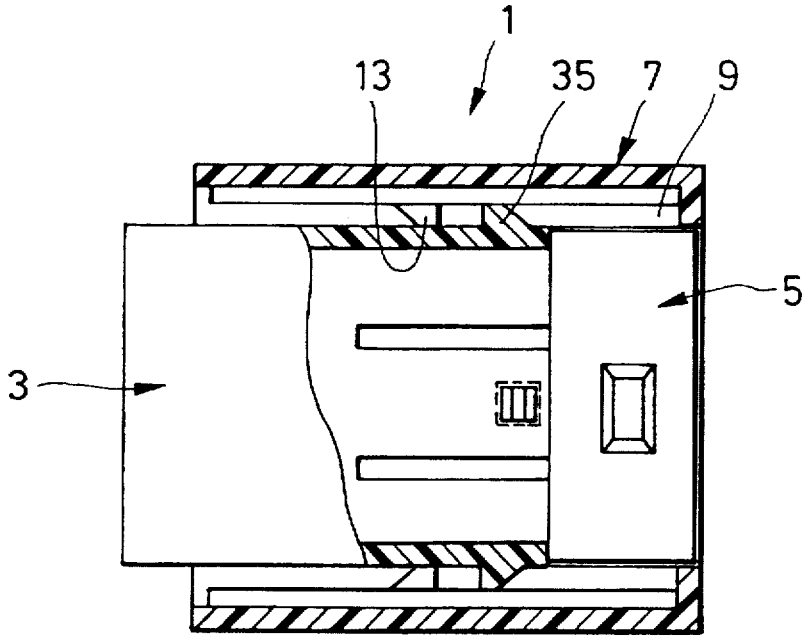
FIG. 9 is an explanatory view showing the movable connector in a condition in which an attachment member is finally fixed to a mounting member.

The operation of the movable connector 1 of this construction will now be described with reference to FIGS. 5 to 9. FIG. 5 is an explanatory view showing the insertion of the female connector into the holder, FIG. 6 is an explanatory view showing a condition immediately before the female connector and the male connector are fitted together, FIG. 7 is an explanatory view showing a condition in which the male connector and the female connector are completely fitted together, FIG. 8 is an explanatory view showing a condition in which the second projections of the male connector are abutted against the respective first projections of the holder, and FIG. 9 is an explanatory view showing the movable connector in a condition in which the attachment member is finally fixed to the mounting member.

As shown in FIG. 5, the female connector 5, having a wire harness (not shown) connected thereto, is inserted into the holder 7, fixedly mounted, for example, on the mounting panel, with its fitting portion 5*b* first introduced thereinto. When the female connector 5 is inserted into the holder 7, the second locks 21 of the female connector 5 abut respectively against the first locks 11 of the holder 7, and when the female connector 5 is further inserted, the first locks 11 of the holder 7 are displaced because of the elastic deformation of the beam portions 9, and the second locks 21 pass past the first locks 11, respectively.

Figure 6:
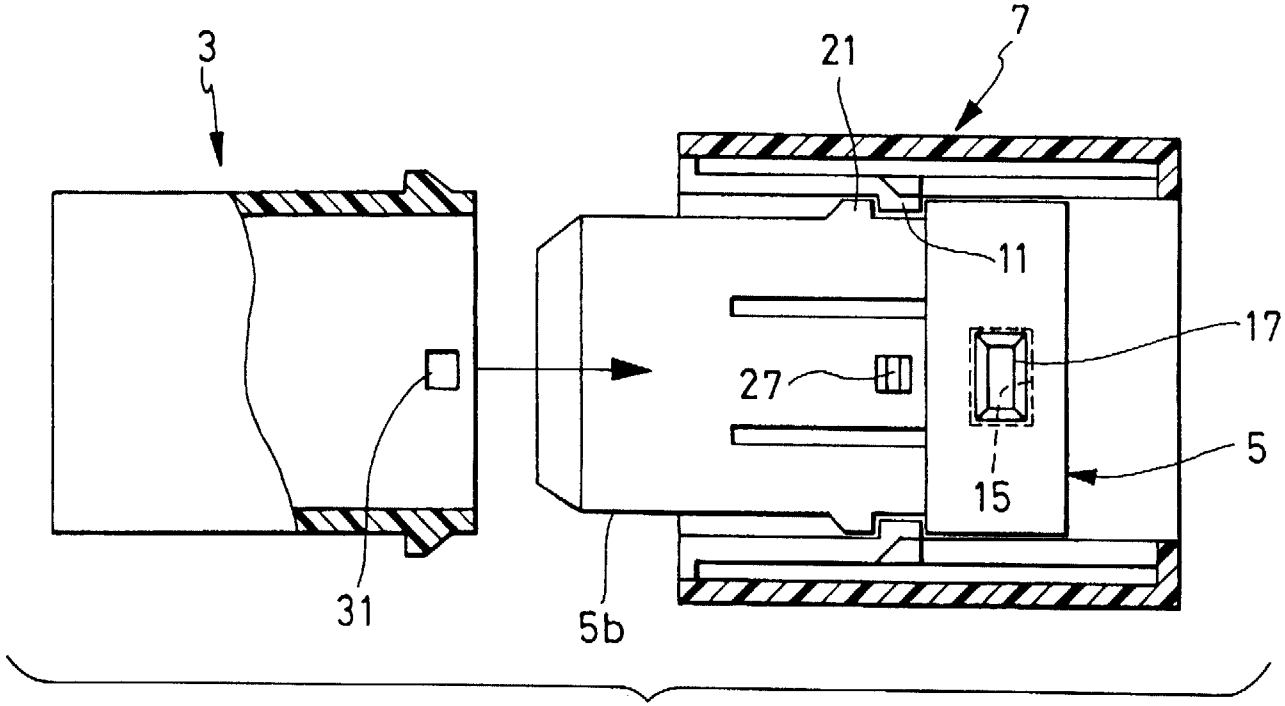
FIG. 6 is an explanatory view showing a condition immediately before the female connector and a male connector are fitted together.

After the second locks 21 of the female connector 5 pass past the respective locks 11 of the holder 7, the first lock 11 are elastically returned to their initial position, and are engaged with the second locks 21 of the female connector 5, respectively, as shown in FIG. 6. At the same time, the convex portions 17 of the female connector 5 are engaged respectively in the first lock holes 15 in the holder 7. Thus, the holder 7 and the female connector 5 are provisionally retained with respect to each other.

Then, the male connector 3 is fitted on the female connector 5 having the fitting portion 5*b* projected from the front end of the holder 7. The male connector 3, fitted on the fitting portion 5*b*, is inserted into the space between the female connector 5 and the holder 7. As shown in FIG. 7, when the front end of the male connector 3 abuts against the step portion 19 of the female connector 5, the fitting of the male connector 3 on the female connector 5 is completed. At the same time, the third lock portions 27 of the female connector 5 are fitted respectively in the second lock holes 31 in the male connector 3.

After the fitting of the male connector 3 on the female connector 5 is thus completed, the instrument panel (not shown), having the male connector 3 fixedly mounted thereon, is fixedly secured by screws or the like to the mounting panel (not shown) having the holder 7 fixedly mounted thereon. As a result, the male connector 3 is further inserted into the holder 7. When the male connector 3 is thus further inserted into the holder 7, the slanting surfaces of the second projections 35 of the male connector 3 abut respectively against the slanting surfaces of the first projections 13 formed on the beam portion 9 of the holder 7, and for example, the upper second projections 35 urge the upper beam portion 9 upward in FIG. 8.

As a result, the first locks 11, formed on the respective beam portions 9, are moved apart from the second locks 21 of the female connector 5, respectively, to thereby release the engagement between each of the first locks 11 and the associated second lock 21, so that the female connector 5 is pushed toward the rear end of the holder 7 by the pushing force of the male connector 3. At this time, the provisional retaining engagement between each convex portion 17 of the female connector 5 and the corresponding first lock hole 15 in the holder 7 is also released.

Figure 10:
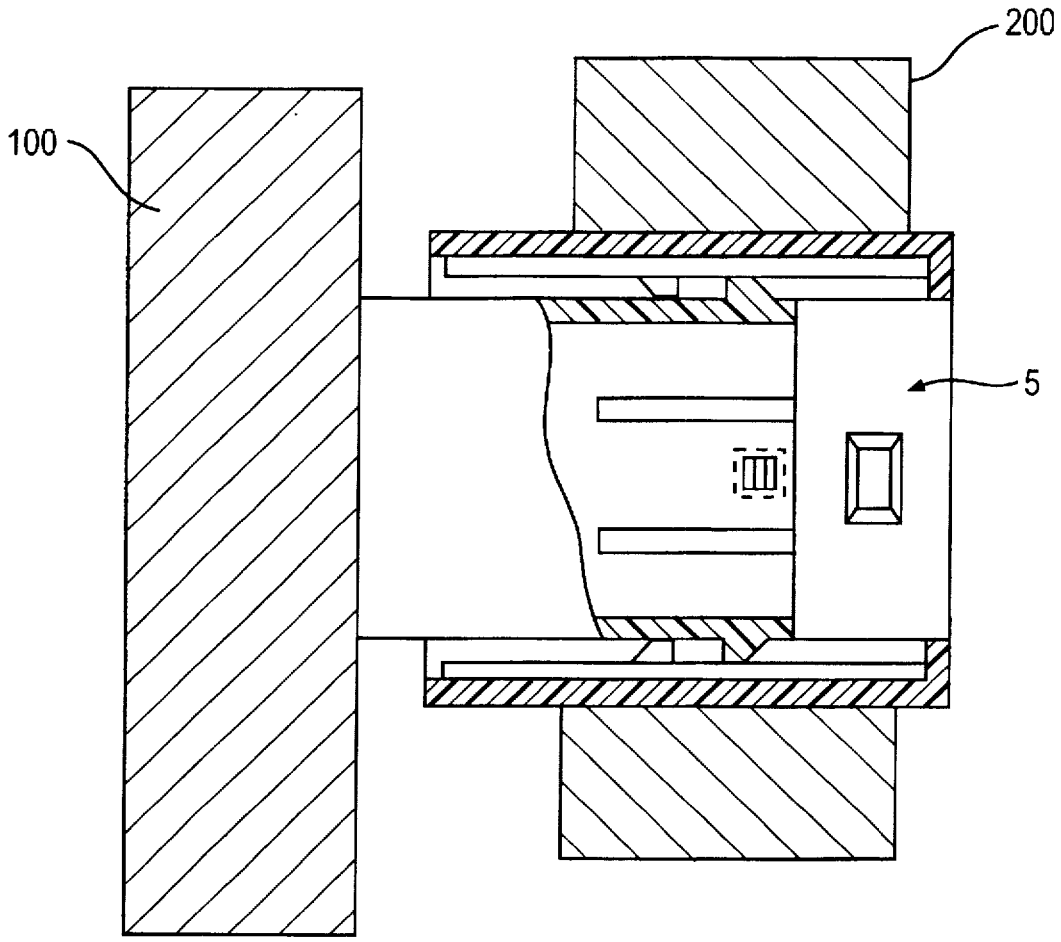
FIG. 10 is a explanatory view showing the movable connector with the mounting panel and attachment panel.

Then, when the instrument panel (not shown) is finally fixed to the mounting panel 200, the pushing of the female connector 5 by the male connector 3 is finished, and in this condition the male connector 3 and the female connector 5 are at the rear portion of the holder 7 as shown in FIG. 10. Namely, in this movable connector 1, when finally fixing the attachment member, the male connector 3 and the female connector 5, already completely fitted together, are pushed to the rear portion of the holder 7 by an amount corresponding to the amount of movement of the attachment member at this time.

For removing the instrument panel from the mounting panel, the fastening of the instrument panel by the screws is released, and the instrument panel is moved away from the mounting panel. When the instrument panel is thus moved away, the male connector 3, fixedly mounted on the instrument panel, is withdrawn from the holder 7. When the male connector 3 is withdrawn from the holder 7, the female connector 5, fitted in the male connector 3, is also moved relative to the holder 7 in this withdrawing direction.

At this time, the slanting surfaces of the second locks 21 of the female connector 5 abut respectively against the slanting surfaces of the first locks 11 of the beam portions 9 of the holder 7, and the first locks 11 of the holder 7 are displaced away from the respective second locks 21 of the female connector 5 because of the elastic deformation of the beam portions 9. Therefore, the first projections 13, formed on the beam portions 9, are also displaced, and during the withdrawal of the male connector 3, the second projections 35 (shown in FIG. 9) of the male connector 3 will not interfere with the first projections 13 on the beam portions 9.

When the second locks 21 of the female connector 5 pass past the respective first locks 11 of the holder 7, the first locks 11 of the holder 7 are again moved toward the female connector 5 because of the elastic restoration, and engage the step portion 19 of the female connector 5, as shown in FIG. 6. As a result, the withdrawal of the female connector 5 is prevented, and the male connector 3 is further moved away from the female connector, and the engagement of the male connector 3 with the third lock portions 27 of the female connector 5 is released, and therefore the male connector 3 is separated from the female connector 5.

Thus, in this movable connector 1, during the withdrawal operation, the condition shown in FIG. 6 is again achieved, and the similar operation is repeated, and the fitting and the separation can be effected repeatedly.

In this movable connector 1, before the attachment member is fixed to the mounting member, the male connector 3 and the female connector 5 are completely fitted together, and therefore even if because of a dimensional error or the like, the attachment member and the mounting member are not fixed together in a perfect manner, that is, they are not in intimate contact with each other, the two connectors are positively fitted together.

Even if the attachment member and the mounting member are separated from each other due to vibrations or the like after they are positively fixed together, the fitting condition will not be immediately released since the two connectors are moved in the fitted condition within the holder.

Therefore, when the attachment member and the mounting member are fixed together, the two connectors, mounted respectively on these members, can be positively fitted together.

As described in detail, in the movable connector of the present invention, before the attachment member is fixed to the mounting member, one connector and the other connector are completely fitted together, and therefore even if the attachment member and the mounting member are not fixed together in a perfect manner, that is, they are not in intimate contact with each other, the two connectors are positively fitted together. Even if the attachment member and the mounting member are separated from each other after they are fixed together, the fitting condition will not be immediately released since the two connectors are moved in the fitted condition within the holder. Therefore, the two connectors can be positively fitted together when the attachment member and the mounting member are fixed together, and the contact stability and the reliability of the connector fitting can be enhanced.

What is claimed is:

1. A movable electrical connector for being mounted on an attachment member and a mounting member to which said attachment member is fixed, said movable connector comprising:

a first electrical connector fixedly mounted on the attachment member;

a holder fixedly mounted on the mounting member; and a second electrical connector, said second connector including a provisional lock for provisionally retaining said second connector to said holder;

wherein said second connector is provisionally retained to said holder before the attachment member and the mounting member are completely fixed together, said second connector is fitted to said first connector as the attachment member approaches the mounting member, and said second connector is movable within said holder by an amount corresponding to an amount of movement of the attachment member required for complete fixing to the mounting member, said second connector being movable within said holder by said first connector disengaging said provisional lock.

2. A movable electrical connector for being mounted on an attachment member and a mounting member to which said attachment member is fixed, said movable connector comprising:

a first electrical connector fixedly mounted on said attachment member;

a holder fixedly mounted on said mounting member;

elastically-deformable beam portions formed on said holder;

first locks projecting from said beam portions, respectively; and a second electrical connector movably attached to said holder;

second locks projecting from said second connector, said second locks being engaged respectively with said first locks to provisionally retain said second connector to said holder until said first connector is fitted to said second connector.

wherein said second connector is provisionally retained to said holder before said attachment member and said mounting member are completely fixed together, said first connector moves to fit to said second connector as said attachment member approaches said mounting member, and said second connector is movable within said holder by an amount corresponding to an amount of movement of said attachment member required for complete fixing to said mounting member.

3. The movable connector of claim 2, further comprising:

a first projection formed on each of said beam portions; and second projections formed on said first connector, wherein when said attachment member further approaches said mounting member after said two connectors are fitted together, said second projections engage said first projections, respectively, to elastically deform said beam portions to move said first locks apart from the respective second locks to thereby release the retaining engagement between each of said first locks and the associated second lock so that said second connector is movable within said holder.

4. A movable electrical connector, comprising:

a first electrical connector;

a holder; and a second electrical connector engaged with said holder;

wherein said first connector disengages said second connector from said holder when said first connector is fitted to said second connector so as to allow movement of said second connector within said holder.

5. The movable connector of claim 4, further comprising:

elastically-deformable beam portions on said holder, wherein said beam portions engage said second connector with said holder;

wherein said first connector disengages said second connector from said holder by deforming said elastically-deformable beam portions.

6. The movable connector of claim 5, further comprising:

first projections on said beam portions; and second projections on said first connector;

wherein said first connector elastically deforms said beam portions to disengage the first connector from the holder when said first projections engage said second projections.

7. The movable connector of claim 4, further comprising:

first locks on said holder; and second locks on said second connector;

wherein said second connector is engaged with said holder by said second locks engaging with said first locks.

8. The movable connector of claim 7, further comprising:

elastically deformable beam portions formed on said holder, said beam portions including said first locks projecting therefrom;

first projections on said beam portions; and second projections on said first connector;

wherein said second projections engage with said first projections as said first connector is inserted into said holder, thereby deforming said beam portions to allow said second locks to pass said first locks.

* * * * *